US007425676B2

(12) United States Patent
Eng

(10) Patent No.: US 7,425,676 B2
(45) Date of Patent: Sep. 16, 2008

(54) COAXIAL CABLE FOR EXTERIOR USE

(75) Inventor: Wing Eng, San Ramon, CA (US)

(73) Assignee: AT&T Intellectual Property L.L.P., Reno, NV (US)

( * ) Notice: Subject to any disclaimer, the term of this patent is extended or adjusted under 35 U.S.C. 154(b) by 0 days.

(21) Appl. No.: 11/222,033

(22) Filed: Sep. 8, 2005

(65) Prior Publication Data

US 2007/0051523 A1 Mar. 8, 2007

(51) Int. Cl.
*H01B 11/06* (2006.01)

(52) U.S. Cl. ..... 174/36

(58) Field of Classification Search ..... 174/110 R, 174/110 SR, 110 F, 28, 36, 102 R, 105 R, 174/108

See application file for complete search history.

(56) References Cited

U.S. PATENT DOCUMENTS 3,147,223 A * 9/1964 Boies et al. ..... 252/75
3,413,227 A * 11/1968 Kearey et al. ..... 508/280
3,625,894 A * 12/1971 Koenig et al. ..... 508/280
4,107,354 A * 8/1978 Wilkenloh et al. ..... 427/118
4,241,973 A * 12/1980 Mayer et al. ..... 439/581
4,343,660 A * 8/1982 Martin ..... 148/269
4,515,992 A * 5/1985 Gupta ..... 174/102 R
4,675,215 A * 6/1987 Ciuba et al. ..... 427/372.2
4,701,575 A * 10/1987 Gupta et al. ..... 174/107
5,254,188 A * 10/1993 Blew ..... 156/53
5,719,353 A * 2/1998 Carlson et al. ..... 174/28
5,724,220 A * 3/1998 Chaudhry ..... 361/119
5,777,535 A * 7/1998 Farfoud et al. ..... 333/243
5,846,355 A * 12/1998 Spencer et al. ..... 156/53
5,949,018 A * 9/1999 Esker ..... 174/23 R
6,201,189 B1 * 3/2001 Carlson et al. ..... 174/102 R
6,236,789 B1 5/2001 Fitz
6,246,821 B1 6/2001 Hemken et al.
6,326,551 B1 * 12/2001 Adams ..... 174/113 C
6,618,526 B2 9/2003 Jackman et al.
6,881,076 B2 * 4/2005 Baker ..... 439/76.1
2002/0039853 A1 * 4/2002 Weingartner ..... 439/314
2004/0007308 A1 * 1/2004 Houston et al. ..... 156/54
2004/0048513 A1 * 3/2004 Egbert ..... 439/578
2004/0171286 A1 * 9/2004 Baker ..... 439/76.1
2005/0159044 A1 * 7/2005 Harwath et al. ..... 439/578

OTHER PUBLICATIONS

ITT Cannon, Data Sheet entitled OT Splice Connector for 734 & 735 Cable Assembly, Jan. 24, 2001.*

ITT Cannon, Product Bulletin entitled Quick Termination (QT) 75 Ohm In-line Splice for Telco Central Office Applications, Mar. 2002.*

* cited by examiner

*Primary Examiner*—William H Mayo, III
(74) *Attorney, Agent, or Firm*—Toler Law Group

(57) ABSTRACT

A coaxial cable for outdoor use having at least one center conductor, at least one dielectric around the conductor with enhanced Structural Return Loss features, a woven braided shield wrapped around the dielectric with superior BNC connector pull testing features, a substantially water-proof insulating jacket wrapped around the shield, and dry floodant dispersed along the interior surface of the jacket. Additionally, an inline protector is connected to at least one end of the cable. In the case where the inline protector is female, the invention contemplates a male BNC connector crimped to the end of the cable for attachment to the protector. A kit includes a length of coaxial cable, an inline protector, and, in certain specific embodiments, a male connector to connect the cable to a female protector port.

19 Claims, 2 Drawing Sheets

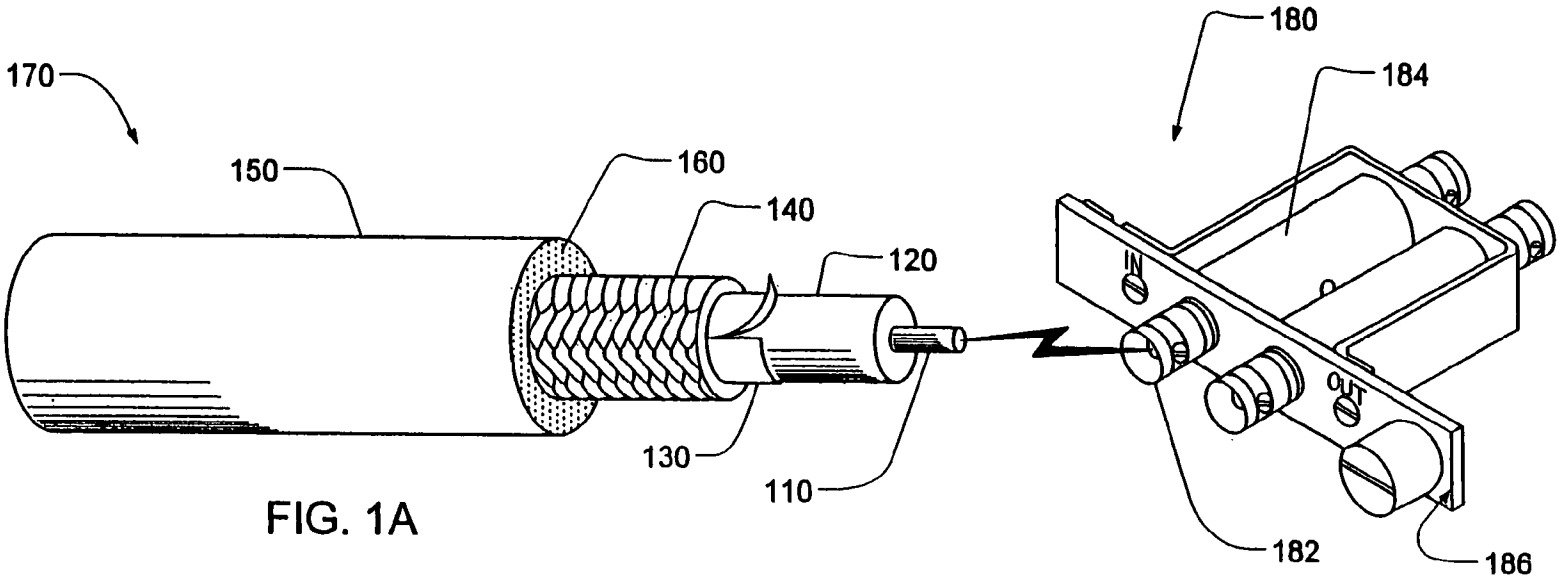
FIG. 1C
FIG. 1A
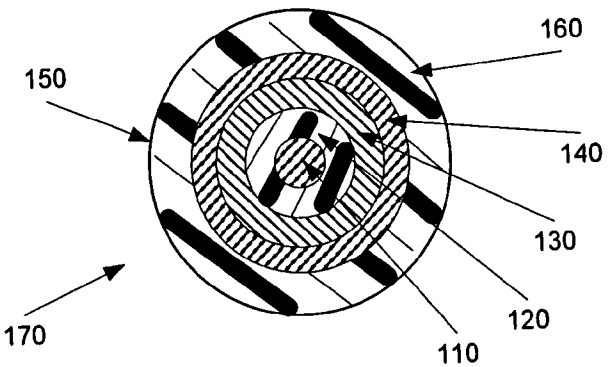
FIG. 1B

COAXIAL CABLE FOR EXTERIOR USE

FIELD OF THE DISCLOSURE

The present disclosure relates to telecommunications, and in particular to exterior coaxial cable for telecommunications transmissions.

BACKGROUND

Coaxial cable is an electrical cable typically designed to carry a high-frequency or broadband signal, such as in a high-frequency transmission line. Coaxial cables of nominal 0.235 inch, or smaller, outer diameter, with BNC connector pull test results exceeding approximately 70 pounds, and Structural Return Loss test results exceeding approximately 35 dB, have only been safely deployed within "indoor" central offices. Such cable products are unable to be used in outdoor or buried environments due to concerns over high-voltage electrical impulse hits from lightning and commercial power company sources.

Additionally, many coaxial cable installers dislike the undesirable and messy gel-filled compounds universally used to protect these cables from outdoor water ingress situations.

BRIEF DESCRIPTION OF THE DRAWINGS

The present disclosure provides the detailed description that follows, by reference to the noted drawings, by way of non-limiting examples of various embodiments, in which reference numerals represent the same parts throughout the several views of the drawings, and in which:

FIG. 1 is a diagrammatic isometric illustration of an exemplary specific embodiment of an outdoor coaxial cable (A), with vertical cross-section of same shown in (B), and inline protector (C) as described herein.

DETAILED DESCRIPTION

Figure 2:
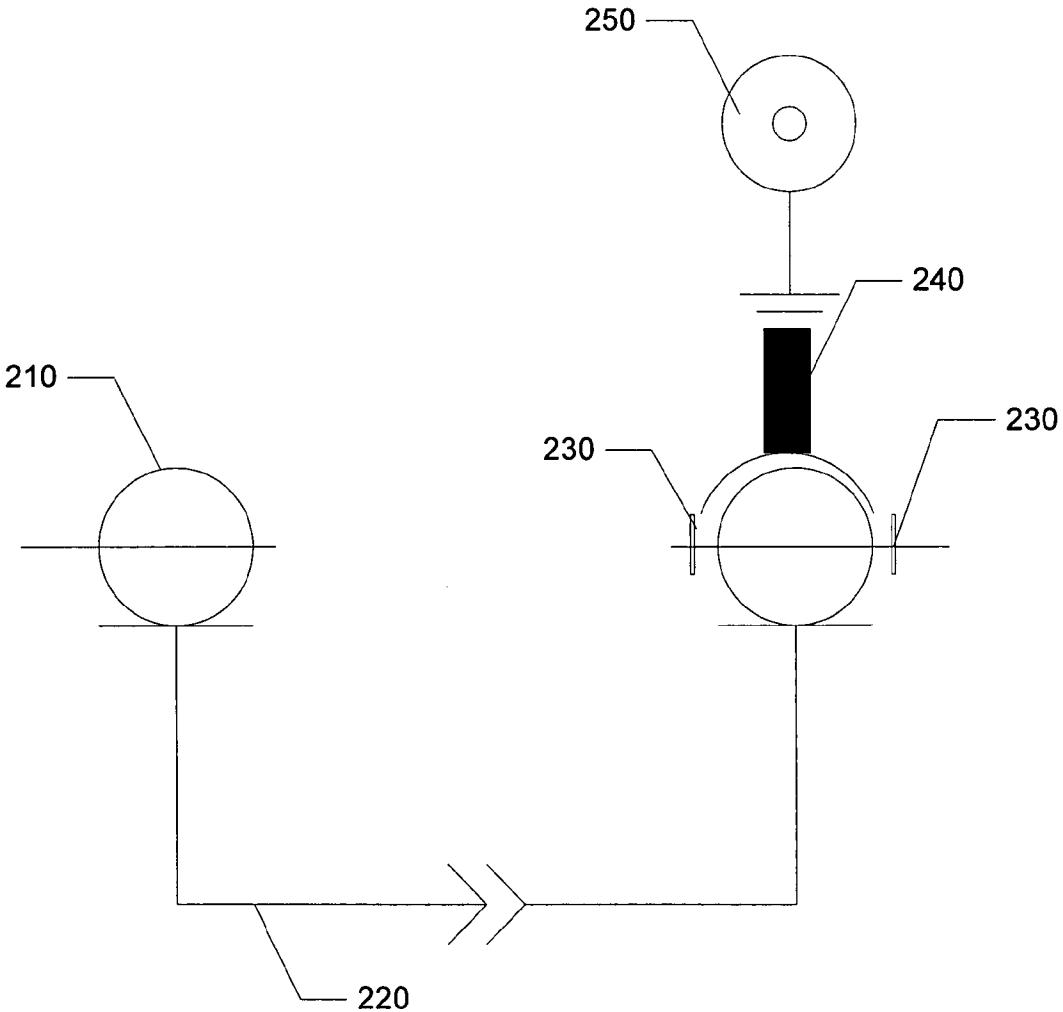
FIG. 2 is a schematic diagram of an exemplary specific embodiment of an outdoor coaxial cable system as described herein.

In view of the foregoing, the present disclosure, through one or more of its various aspects, embodiments and/or specific features or sub-components, is thus intended to bring out one or more of the advantages that will be evident from the description. The description makes reference to a variety of specific embodiments. The terminology, examples, and embodiments, however, are merely illustrative and are not intended to limit the scope of the claims.

This disclosure makes frequent reference to published standards, requirements, specifications, definitions, and the like, such as ASTM, GR/CORE, SCTE and so forth. It is understood that all such published authorities are incorporated herein by reference.

Presently, to run exterior coaxial cable such as those used for cable television purposes, very large solid aluminum core cables with outer diameters exceeding 2 inches, or smaller outer diameter coaxial cables which have BNC connector pull test results typically lower than 40 pounds, and Structural Return Loss test results under 35 dB are deployed. In contrast, the present disclosure provides smaller outer diameter outdoor coaxial cable, made to commercial manufacturing specifications, which is much more flexible, and has higher pull test values and improved structural return loss values, in comparison to the typical exterior cables used for cable television purposes. Cable of the present disclosure complies with current commercial outdoor requirements for copper communications cables used in outdoor environments.

The present disclosure addresses the problems of water ingress and undesired mess from the gel-filled compounds by providing a "dry floodant" compound within the inside jacket of outdoor coaxial cables. Dry floodants are dry, powdery, hydroscopic substances that absorb and sequester water in amounts many times greater than the mass of the floodant substance. The hydroscopic material absorbs excessive water that may infiltrate the cable products, and to sequester the water away from the conductive elements of the cable. Dry floodants are used by at least one coaxial cable manufacturers such as, for Example, CommScope™ of 1100 CommScope Place SE, Hickory, N.C. 28603-1729.

The problems of high-voltage and commercial power hits is addressed by using an In-Line Protector in conjunction with the outdoor dry floodant coaxial cables. The combination of an In-Line Protector with dry floodant provides two-fold protection from electrical discharge hits while providing a thin and flexible coaxial cable for outdoor use. The present disclosure addresses the problems of electrical discharge hits and messy compounds, and also provides additional advantages such as thinner, more flexible, coax cable, enhanced BNC connector pull test results and enhanced Structural Return Loss test results, than is presently available for exterior use.

FIG. 1 is a diagrammatic isometric illustration of an exemplary specific embodiment of an outdoor coaxial cable (A), with vertical cross-section of same shown in (B), and inline protector (C) as described herein. Outside Plant Coaxial Cable of the present disclosure are useful for the direct buried interconnection of outside-related telecommunications equipment. The parameters of the present disclosure are sufficiently broad to provide a product in which the particular characteristics of the cable may be varied to satisfy the specific requirements of a given application. The cables may contain appropriately sized annealed copper or silver-coated copper conductor 110, which may be covered by a dielectric of polyolefin material 120. The dielectric core may be covered with an outer conductor of an aluminum laminated foil 130, a tinned copper braid 140, and a black polyethylene (PE) jacket overall 150, coated on the interior surface with dry floodant hydroscopic powder 160.

The types of coaxial cable covered by this disclosure are listed in table 1.

TABLE 1

Types of Coaxial Cable

| Cable Type | Dielectric | Jacket Color | Number of Conductors |
|---|---|---|---|
| 734 | Foam PE | Black | 1 |
| 734 | Foam PE | Black | 3 |
| 734 | Foam PE | Black | 6 |
| 734 | Foam PE | Black | 9 |
| 734 | Foam PE | Black | 12 |
| 734 | Foam PE | Black | 15 |
| 735 | Foam PE | Black | 1 |
| 735 | Foam PE | Black | 3 |
| 735 | Foam PE | Black | 6 |
| 735 | Foam PE | Black | 9 |
| 735 | Foam PE | Black | 12 |
| 735 | Foam PE | Black | 15 |

To assure that outside plant coaxial cable is properly installable, the present cable is compatible with installation equipment, including terminating equipment and outdoor approved coaxial connectors such as, for example, BNC-type connectors.

Continuing with FIG. 1, inline protector 180 connects to cable 110 at in-port 182, for example, which provides protective unit 184 extending toward the interior of the installation site to protect against electrical discharges. Mounting bracket 186 allows protector 180 to be mounted near the exterior wall of an installation site.

FIG. 2 is a schematic diagram of an exemplary specific embodiment of an outdoor coaxial cable system as described herein. Cable line origin 210 may be, for example, a Central Office or a repeater station. Outdoor cable 220 extends outdoors to installation site wall 230 and is connected to in-line protector 240 which traverses wall 230 and provides protection to cable 220 from external electrical hits such as from lightning. Interior coaxial jack 250 connects to protector 240 to provide a connection for interior-grade coaxial cable to be run through the interior of the installation site.

Outdoor coaxial cable of the present disclosure meets stringent transmission characteristics for impedance and loss. Conductor, dielectric, and braided shield diameters are carefully controlled. The recommended dimensional characteristics are set forth in Table 2.

TABLE 2

| Coaxial Cable Dimensional Requirements | | | | | |
|---|---|---|---|---|---|
| Cable Type | Conductor Type | Conductor Diameter (Inch) | Dielectric Diameter (Inch) | Shield Diameter (Inch) | Overall Diameter (Inch) |
| 734 | Cu, silver plated | 0.032 ± 0.001 | 0.148 ± 0.002 | 0.185 ± 0.003 | 0.235 ± 0.005 |
| 735 | Cu, silver plated | 0.0161 ± 0.002 | 0.077 ± 0.002 | 0.108 ± 0.003 | 0.134 ± 0.003 |

Copper conductors meet the requirements of ASTM B 3, and silver plated copper meet the requirements of ASTM B-298 entitled "Specification for Silver-Coated Soft or Annealed Copper Wire." Class A Minimum.

Factory joints are not recommended after final draw to size, and conductors are recommended to be uniform, clean, and free from kinks, scales, and other flaws.

The minimum elongation of the center conductor from completed cable is recommended be tested according to procedures of ASTM E-8. The coated or uncoated copper conductor is recommended to have a minimum elongation of 14% for all types.

The dielectric is, preferably, an insulating grade of stabilized polyolefin of 100% virgin material that has not been reprocessed. Definitions of reprocessed and virgin may be found in ASTM D 883. The dielectric meets all of the requirements of ASTM D 1248, preferably contains an antioxidant system including a copper inhibitor that meets the thermal oxidative stability requirements of GR-1398-CORE, Issue 1, Section 4.2.3, and may be of natural color.

The foam dielectric material may be an insulating grade of polyolefin and is recommended to meet the requirements of GR-1398-CORE, Issue 1 Section 4.2. The dielectric may be concentrically extruded over the conductors so that the geometric centers of the conductor and the dielectric are no more than approximately 0.002 inch apart for type 735 and approximately 0.003 inch apart for the other types.

Improperly extruded polyolefin may have internal stresses that cause shrinkback with the passage of time and exposure to thermal variations. Therefore, it is recommended that completed cables meet the following shrinkback test: Placed a six-inch sample of dielectric coated center conductor, preferably taken from the center of a six-foot sample of cable, on a piece of preconditioned felt in a circulating air oven for 4 hours at 115°±1° C. (239°±2° F.). Avoid pulling, crushing, or flexing the sample. After cooling the sample to room temperature there will be exposed conductor at each end if shrinkback occurs. The sum of the exposed conductor at the two ends should not exceed ¼ inch (6.4 mm), including all the change in length that occurs from the time the specimens are cut.

Controlled adhesion of the dielectric to the center conductor is recommended to allow for the removal of the dielectric in cable termination procedures. The recommended force required to strip the dielectric when tested per SCTE IPS-TP-005 meets the requirements shown in Table 3.

TABLE 3

| Min/Max Force to Break Adhesive Bond | | |
|---|---|---|
| Cable Types | Minimum Force | Maximum Force |
| 734 | 6 lbs. | 16 lbs. |
| 735 | 1 lbs. | 3 lbs. |

For foam dielectric cables, the outer conductor or shield of the coaxial cable is recommended to provide an aluminum-laminated foil and a tinned copper braid.

The laminated shielding tape may be made of aluminum and a dielectric grade polyester or polypropylene foil, with sufficient aluminum content to meet all the electrical or mechanical requirements for given application. The tape may be longitudinally applied with an overlap and the aluminum side facing out. Over the shielding tape, a layer of bonding resin may be applied to construct the bonded aluminum tape. The tape is recommended to be sufficiently bonded to the dielectric and at the overlap to prevent delamination upon connector insertion, while allowing for easy removal upon preparation, such as stripping, for installation of connector.

The aluminum foil material is recommended to conform to the requirements of ATSM B 479 for Alloy 1235, 1200, 1145, or 1100.

It is recommended that the individual braid wires for the outer conductor meet all the requirements of ASTM B33 for tinned copper conductors. Outer braid shield constructed of 36 gauge strands for 735 type cables and either 34 or 36 gauge for 734 cables is also recommended. The outer braid coverage is recommended to be approximately 95% average for 735 type and approximately 85% average for 734 type. The angle of the shield braid is recommended to be between approximately 15 and approximately 45 degrees. Calculate braid coverage using, for example, the method specified in GR-1398-CORE, Section 4.3.2.2.

Examine the braid for uniformity and snugness. Apply the braid such that minimizes irregularities, breaks, and other discontinuities in so far as commercially practical. The outer surface of the braid contains an appropriate dry floodant water-blocking.

When a complete carrier break occurs, it is recommended that the wires not be missing for more than two turns of braid and that there not be more than one complete carrier break at any point along the cable. Aside from carrier breaks, it is recommended that there not be more than three strands of conductor missing in any cross section of cable. Neatly trim the ends when wire breaks do occur. A broken end should not extend through the outer jacket. Jacket materials, such as polyethylene (PE) may be selected, for example, from the list specified in GR-421-CORE, Issue 1, December 1998, Generic Requirements for Metallic Telecommunications Cables.

The inside wall of the outer jacket contains an appropriate dry floodant water-blocking powder of material. It is convenient to mark the outer jacket sequentially in footage every approximately 24 inches and to have multi-conductor composite cable numerically identified on each sub unit at a maximum of every approximately twelve 12 inches.

The jacket is recommended to be substantially water-proof and insulating, smooth and free of openings and other defects, and to exhibit no significant porosity when examined under 5× magnification. Patched or repaired jacket material is not recommended.

Cable that withstands a cold bend test at −20°±1° C. (−4°±2° F.) is recommended. Cold testing may be performed pursuant to SCTE IPS-TP-001, Test Method for Cold Bend. Consider a failure any visual sign of cracks, flaws, or other damage examined with normal or corrected to normal vision.

Cable of the present disclosure meets the fire resistance requirements of GR-63-CORE, *Network Equipment—Building System (NEBS) Requirements: Physical Protection (a module of LSSGR, FR-64; TSGR, FR-440; and NEBSFR, FR-2063)*, and National Electrical Code. The flammability rating of this cable is recommended be at least CM.

Abrasion resistance is advantageous to provide for adequate service life of the coaxial cable when it is exposed to abrasion incurred during installation due to abrasive wear from concrete columns, metal plenum support struts, and other surfaces with which the cable may come in contact during its service life. For example, the jacket of four out of five samples of completed cable should withstand a minimum of 1000 passes without exposure of the cable shield when observed with normal or corrected to normal vision. Testing to determine abrasion resistance may be performed, for example, as follows:

1. A 1.000±0.005 inch (25.4±0.13 mm) diameter Norton abrasive precision grinding wheel and the cable sample mounted such that a normal force of 4.0 pounds (17.8N) minimum is maintained at the tangent point of the insulation and the abrading wheel.
2. The test specimen positioned so that the abrasive wheel makes simultaneous contact with a point on the jacket of the conductor core. The tangent points of contact move along the longitudinal length of the test specimen for a minimum distance of approximately five (5) times the diameter of the abrading wheel during each pass.
3. Either the cable or the wheel is in motion. The velocity of the moving component relative to the stationary component may be approximately ½ foot/second (153 mm/second) minimum. Passes are defined as the number of times a fixed point on the stationary component passes the moving component. It is recommended that the abrading wheel not be cleaned during the individual test cycle.
4. Abrasive wheels are available from the Norton Company, Worcester, Mass., for example: 7A60-M5VBE Precision Internal Wheel 1.000×2⅜ inch diameter limit±0.005 inch. The diameter may have to be ground to size.

It is recommended that the jacket of the cable conform to the UV resistance requirements as stated in GR-2949-CORE, Issue 1, Section 6.5, for light absorption.

It is recommended that the cable conform to the water penetration requirements as stated in GR-2949-CORE, Issue 1, Section 6.7, for a three (3) foot water test for four (4) hours.

It is recommended that the outer jacket of the cable conforms to the impact requirements as stated in GR-2949-CORE, Issue 1, Section 6.11, for impact resistance.

It is recommended that the resistance of the center conductor in completed cable not exceed approximately 11.0 ohms/1000 ft. for 20 AWG copper conductors (Type 734) and 40 ohms/1000 ft. for silver plated, and 43.0 ohms/1000 ft. for tin coated 26 AWG copper conductor (Type 735), respectively, for measurements made at or corrected to 68 F (20 C).

It is recommended that insulation resistance between the center and outer conductors not be less than 5000 megohm-kft when measured per GR-492-CORE.

It is recommended that the dielectric strength between the center and outer conductor of the coaxial cable be tested per UL 444, Section 5.3.4.

The characteristic impedance of coaxial products of the present disclosure is recommended to be approximately 75±2 ohms over the frequency range of 5 to 150 MHz. Impedance measurements may be made on respective samples of completed cable over the frequency range per SCTE IPS-TP-006, *Test Method for Coaxial Cable Impedance*, by fixed bridge methodology.

The attenuation of a coaxial cable of the present disclosure is recommended to be measured per SCTE IPS-TP-009. The maximum attenuation values are shown in Table 4.

TABLE 4

| Attenuation at 20° C. (68° F.), Maximum dB/100 ft | | |
|---|---|---|
| Freq. (MHz) | 734 | 735 |
| 1 | 0.28 | 0.5 |
| 5 | 0.59 | 1.1 |
| 10 | 0.80 | 1.5 |
| 22.5 | 1.18 | 2.30 |
| 50 | 1.82 | 3.40 |
| 100 | 2.60 | 4.99 |
| 150 | 3.22 | 6.0 |

Structural return loss (SRL) measurements may be made by sweep testing on a cable length of 100 feet minimum, terminated with a non-inductive, low capacitance, resistance of 75 ohms±0.1%. It is recommended that the terminating resistance have a return loss over the measurement band of at least approximately 45 dB when connected directly to the output of the test set. Measurement of the return loss should include all connectors required for testing the cable. The recommended method of testing is per SCTE IPS-TP-007, *Test Method for Coaxial Cable Structured Return Loss*. The recommended specified requirements for two product types are shown in Table 5.

TABLE 5

| Structural Return Loss, Recommended Minimum dB | |
|---|---|
| Cable Type | Minimum dB |
| 734 | 35 dB @ 5-150 MHz |
| 735 | 35 dB @ 5-150 MHz |

To assure the jacket is free of holes, gaps, and other defects that would allow the outer conductor to electrical short to other conductors, a spark test is recommended on all coaxial cable in accordance with GR-492-CORE, Section 7.12.

It is recommended that each conductor of a multi-conductor type cable meet all requirements of the appropriate type single cable with the exception of SRL, which may be degraded no more than approximately three-(3) dB. A dielectric strength test at 3000 volts ac, 60 Hz or 4200 volts dc is recommended be applied between the outer conductor (shield) of each conductor and those of all remaining conductors.

Outdoor coaxial cable for outside plant use may be subjected to electrical discharge hits from lightening or other weather phenomenon, as well as from industrial sources. To proved safety measures from such electrical discharge hits, the coaxial cable of the disclosure, described above, connects to an in-line protector that shields equipment distally connected to the protector from electrical surges.

For example, TII Network Technologies, Inc. provides protector panels such as, for instance, the TII 706-19-1 DS-3 Protector panel. The DS-3 panel has an "in" female jack and an "out" female jack. Each jack has exterior access ports and inside plant protective cuffs that shield inside plant equipment connected to the panel from electrical surges that would otherwise ingress through the jacks. Some inline protector jacks provide a pin and slot locking mechanism for secure connections to compatible male connectors.

To connect a coaxial cable of the present disclosure to an inline protector jack such as found with the DS-3 Protector Panel, crimp a compatible male connector to one end of the coaxial cable and connect the male connector to the female jack. The combination of dry floodant and inline protection allows a coaxial cable of the disclosure to be thin and flexible for easy installation, yet durable and safe for outdoor use.

A coaxial cable for outdoor use of the present disclosure includes, but is not necessarily limits to at least one center conductor, at least one dielectric around the conductor, a shield wrapped around the dielectric, a substantially waterproof insulating jacket wrapped around the shield, and dry floodant dispersed along the interior surface of the jacket. Additionally, an inline protector is connected to at least one end of the cable. In the case where the inline protector is female, the disclosure contemplates a male connector crimped to the end of the cable for attachment to the protector.

The present disclosure further contemplates a kit that includes but is not necessarily limited to, a length of coaxial cable as described herein, an inline protector, and, in certain specific embodiments, a male connector to connect the cable to a female protector port.

The following describes recommended installation practices. Properly strip the outdoor rated 734C or 735C coaxial cable with dry floodant powder before crimping the BNC coaxial connectors to both ends of the cables. Although any suitable stripping tool may be used to strip the coax, a programmable cable stripper may provide the desired accuracy. Alternatively, in lieu of a programmable cable stripper, an AC powered hand-held, cable stripper may be used.

After stripping both ends of the cable, an outer cylindrical-shaped, hollow, nickel-plated crimp sleeve from the BNC connector should be inserted over both ends of the cable. Next, the outer tinned copper stranded wire braid of the stripped cable is flared out using a metal pick or equivalent tool. The braid should be inspected to make sure that individual stranded members have not been accidentally cut through resulting in loss of braid material and undesired loss of connector to cable retention.

The gold plated, hollow-center connector contact pin is inserted over the silver-plated center conductor of the stripped cable and crimped with a 12 point dimple center pin crimping tool. The body of the BNC connector is then to be inserted over the crimped center pin of the stripped cable until it firmly engages the inside wall of the flared out braid of the cable and a "snap-in" of the crimped center pin to the connector body is felt.

The outer crimp sleeve of the BNC connector is moved forward over the flared braid of the cable and crimped to the cable/cable body using a calibrated pneumatic-assisted hex-type or calibrated hand-held hex-type crimping tool. The crimped-on BNC connector should be "hand pulled" to make sure they do not pull out from the coaxial cables. The expected retention of the BNC connectors to the 735C type outdoor coaxial cable is expected to be a minimum of 60 pounds and to average around 75 pounds. The expected retention of the BNC connectors to the 734C type outdoor coaxial cable is expected to be a minimum of 60 pounds and to average around 105 pounds.

Properly stripped and crimped coaxial cables are recommended to be deployed within Schedule 40 PVC plastic tubing and terminated, or twist-locked, onto DS3 In-Line Protector Panels that protect against foreign high voltages such as that from lightning strikes. The 734C or 735C outdoor-rated coaxial cables are expected to properly transport DS3 transport signals at the 44.736 Mb/sec (44.736 mega (million) bits per second) line rate.

The use of the present outdoor coaxial cables, BNC connectors and DS3 In-line Protectors is an alternative to the use of more expensive fiber optic cable and connector options.

The Abstract of the Disclosure is provided to comply with 37 C.F.R. § 1.72(b), requiring an abstract that will allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate embodiment.

The description has made reference to several exemplary embodiments. It is understood, however, that the words that have been used are words of description and illustration, rather than words of limitation. Changes may be made within the purview of the appended claims, as presently stated and as amended, without departing from the scope and spirit of the disclosure in all its aspects. Although particular means, materials and embodiments have been described, the disclosure is not intended to be limited to the particulars disclosed; rather, the disclosure extends to all functionally equivalent technologies, structures, methods and uses such as are within the scope of the appended claims.

I claim:

1. A coaxial cable for outdoor use, the cable comprising:

a center conductor having a structural return loss of at least 35 db;

a dielectric surrounding the conductor;

a shield surrounding the dielectric, wherein the shield has a braid;

a substantially water-proof insulating jacket surrounding the shield, the jacket having an interior surface;

dry floodant hydroscopic powder dispersed on the interior surface of the jacket such that substantially all of the dry floodant hydroscopic powder is located between the jacket and the shield; and an inline protector connected to at least a first end of the cable.

2. The cable of claim 1, wherein the exterior diameter of the cable is approximately 0.235 inch or less.

3. The cable of claim 1, wherein the exterior diameter of the cable is approximately 0.134 inch or less.

4. The cable of claim 1, wherein water penetration of the jacket meets or exceeds GR-421-2949-CORE, Issue 1, Section 6.7 for a three foot water test for four hours.

5. The cable of claim 1, wherein the dielectric comprises insulating grade foam polyolefin.

6. The cable of claim 1, wherein the shield comprises shielding tape of aluminum-laminated foil.

7. The cable of claim 1, wherein the cable withstands a cold bend test at −20° C. performed pursuant to SCTE IPS-TP001.

8. The cable of claim 1, wherein the inline protector comprises a female connector, and a male connector connected to the female connector and to the first end of the cable.

9. The cable of claim 8, wherein the male connector comprises a BNC-type connector.

10. The cable of claim 1, further comprising a BNC-type connector connecting the inline protector to the cable.

11. The cable of claim 1, wherein the dielectric comprises virgin, unreprocessed material.

12. The cable of claim 1, wherein the cable comprises cable type 734.

13. The cable of claim 1, wherein the cable comprises cable type 735.

14. The cable of claim 1, wherein the conductor comprises copper.

15. The cable of claim 1, wherein the cable comprises cable type 734 and the number of conductors is 1, 3, 6, 9, 12, or 15.

16. The cable of claim 1, wherein the cable comprises cable type 735 and the number of conductors is 1, 3, 6, 9, 12, or 15.

17. A kit comprising:

a length of coaxial cable having at least one end, the cable further comprising a center conductor having a structural return loss of at least 35 db; a dielectric surrounding the conductor; a shield surrounding the dielectric, wherein the shield has a braid; a substantially water-proof insulating jacket surrounding the shield, the jacket having an interior surface; and dry floodant hydroscopic powder dispersed on the interior surface of the jacket such that substantially all of the dry floodant hydroscopic powder is located between the jacket and the shield; and an inline protector adapted for connection to the end of the cable.

18. The kit of clam 17, the kit further comprising a connector to connect the inline protector to the end of the cable.

19. The kit of claim 17, wherein the cable is type 734 or type 735.

* * * * *